US008763696B2

(12) United States Patent
Bedouet et al.

(10) Patent No.: US 8,763,696 B2
(45) Date of Patent: Jul. 1, 2014

(54) FORMATION TESTING

(76) Inventors: Sylvain Bedouet, Houston, TX (US); Karre Otto Eriksen, Stavanger (NO)

( * ) Notice: Subject to any disclaimer, the term of this patent is extended or adjusted under 35 U.S.C. 154(b) by 539 days.

(21) Appl. No.: 12/983,956

(22) Filed: Jan. 4, 2011

(65) Prior Publication Data

US 2011/0259581 A1 Oct. 27, 2011

Related U.S. Application Data

(60) Provisional application No. 61/328,503, filed on Apr. 27, 2010.

(51) Int. Cl.
*E21B 49/08* (2006.01)

(52) U.S. Cl.
USPC ..... 166/264; 175/60; 175/207

(58) Field of Classification Search
USPC ..... 175/59, 60, 206, 207, 264; 166/264
See application file for complete search history.

(56) References Cited

U.S. PATENT DOCUMENTS

| | | | | |
|---|---|---|---|---|
| 4,310,058 | A | 1/1982 | Bourgoyne | |
| 4,547,691 | A | 10/1985 | Valdois et al. | |
| 4,860,581 | A | 8/1989 | Zimmerman et al. | |
| 5,394,345 | A | 2/1995 | Berard et al. | |
| 5,635,631 | A | 6/1997 | Yesudas et al. | |
| 5,799,733 | A | 9/1998 | Ringgenberg et al. | |
| 7,379,180 | B2 | 5/2008 | Vannuffelen et al. | |
| 7,530,392 | B2 * | 5/2009 | Sugiyama et al. | 166/263 |
| 7,586,087 | B2 | 9/2009 | Dong et al. | |
| 7,594,541 | B2 | 9/2009 | Ciglenec et al. | |
| 2003/0217866 | A1 * | 11/2003 | deBoer | 175/66 |
| 2004/0238177 | A1 * | 12/2004 | Fossli | 166/364 |
| 2008/0066535 | A1 | 3/2008 | Vasques et al. | |
| 2008/0257036 | A1 | 10/2008 | Chaudoreille et al. | |
| 2008/0319685 | A1 | 12/2008 | Xie et al. | |
| 2009/0044951 | A1 | 2/2009 | Milkovisch et al. | |
| 2009/0078036 | A1 | 3/2009 | Terabayashi et al. | |
| 2012/0279702 | A1 * | 11/2012 | Bedouet et al. | 166/250.03 |
| 2013/0025855 | A1 * | 1/2013 | Glattetre et al. | 166/264 |

FOREIGN PATENT DOCUMENTS

WO 2008100156 8/2008

OTHER PUBLICATIONS

Kuchuk, Fikri et al., Radius of Investigation for Reserve Estimation from Pressure Transient Well Tests, SPE 120515, pp. 1-21.

Lage, Antonio C.V.M. et al., An Experimental and Theoretical Investigation of Upward Two-Phase Flow in Annuli, SPE 79512, 2000 SPE Asia Pacific Oil and Gas Conference, Brisbane, Australia, Oct. 16-18, 2000, pp. 325-336.

Monteiro, E.N. et al., Study of the PVT Properties of Gas—Synthetic Drilling Fluid Mixtures Applied to Well Control, SPE 116013, Denver, Colorado, Sep. 21-24, 2008, pp. 1-15.

Silva, C.T. et al., Gas Solubility in Synthetic Fluids: A Well Control Issue, SPE Annual Technical Conference & Exhibition, Houston, Texas, Sep. 26-29, 2004, pp. 1-6.

International Search Report and Written Opinion for International Application No. PCT/US2011/033243 dated Oct. 25, 2011.

* cited by examiner

*Primary Examiner* — David Andrews

(57) ABSTRACT

Formation testing which may involve circulating mud in a pipe string from a mud pit through a port in the pipe string to a downhole diverter sub, wherein the pipe string is suspended in a wellbore extending into a subterranean formation, operating a downhole pump to pump formation fluid from the formation, wherein the formation fluid comprises gas, and mixing the pumped formation fluid with circulated mud such that a proportion of the pumped formation gas in the circulated mud is maintained below a threshold value.

19 Claims, 5 Drawing Sheets

FORMATION TESTING

CROSS-REFERENCE TO RELATED APPLICATIONS

This application claims priority to and the benefit of earlier filed U.S. Provisional Application No. 61/328,503, entitled "FORMATION TESTING," filed Apr. 27, 2010, the entire disclosure of which is hereby incorporated by reference.

FIELD OF THE DISCLOSURE

Aspects of the disclosure relate to well drilling. More specifically, aspects of the disclosure relate to subterranean formation testing by a downhole tool.

BACKGROUND OF THE DISCLOSURE

Patent Application Publication Number WO2008/100156 entitled "Assembly and Method for Transient and Continuous Testing of an Open Portion of a Well Bore" discloses an assembly for transient and continuous testing of an open portion of a well bore. The assembly is arranged in a lower part of a drill string, and comprises a minimum of two packers fixed at the outside of the drill string, wherein the packers are expandable for isolating a reservoir interval. The assembly also includes a down-hole pump for pumping formation fluid from the reservoir interval and a mud driven turbine or electric cable for energy supply to the down-hole pump. The assembly further has a sample chamber and sensors and telemetry for measuring fluid properties as well as a closing valve for closing the fluid flow from said reservoir interval. The assembly further has a circulation unit for mud circulation from a drill pipe to an annulus above the packers and feeding formation fluid from said down-hole pump to the annulus. The sensors and telemetry are for measuring and real-time transmission of the flow rate, pressure and temperature of the fluid flow from said reservoir interval, from the down-hole pump, in the drill string and in an annulus above the packers. The circulation unit can feed formation fluid from said reservoir interval into said annulus. The disclosure of Patent Application Pub. No. WO2008/100156 is incorporated herein by reference.

Conventional apparatus do not provide for transient pressure formation testing. Moreover, conventional apparatus do not provide for formation testing involving a draw-down phase of a formation undergoing a pressure transient.

BRIEF DESCRIPTION OF THE DRAWINGS

The present disclosure is best understood from the following Detailed Description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
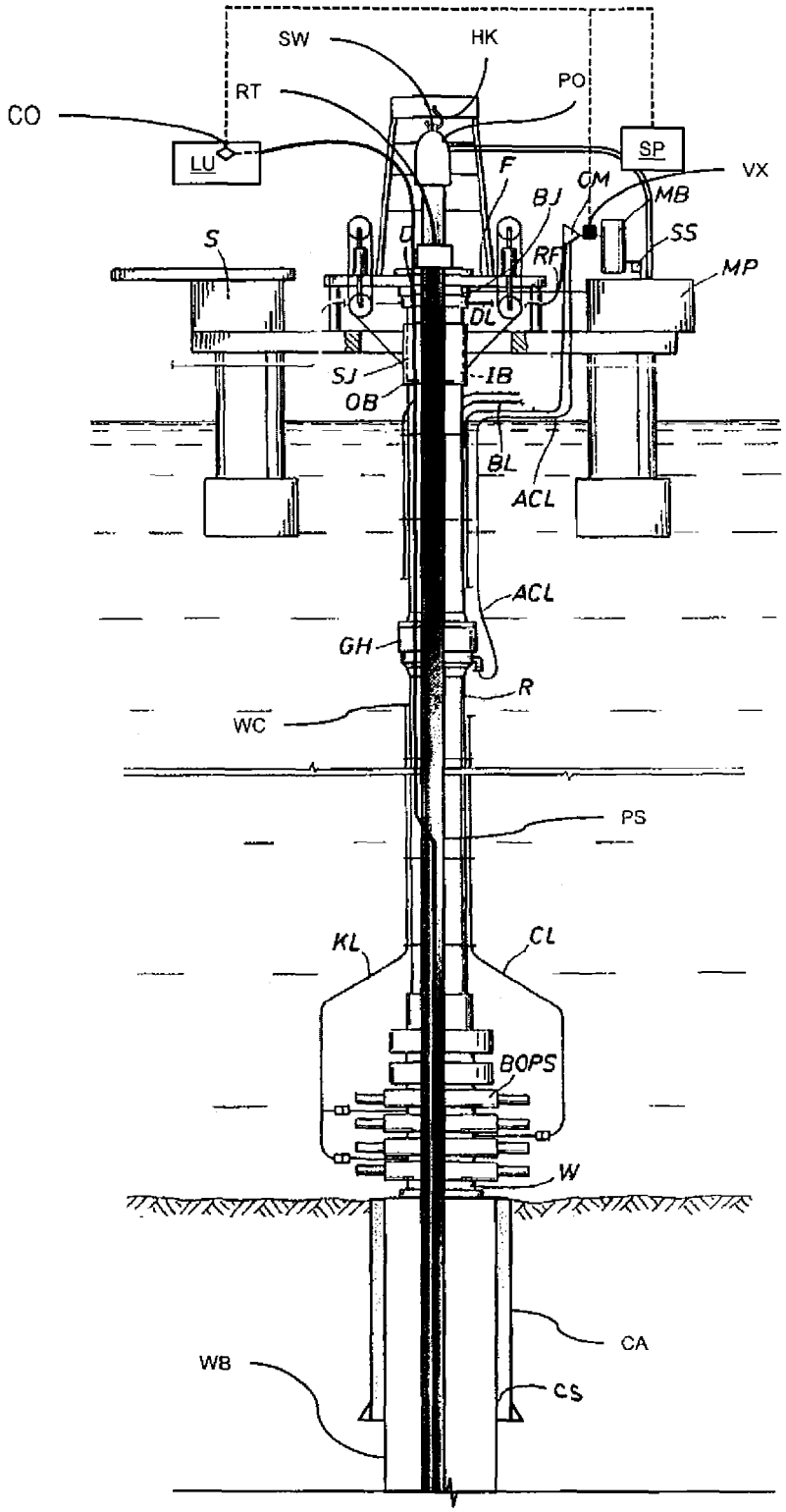
FIG. 1 is a schematic view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting of the scope of the aspects. In addition, this disclosure may repeat reference numerals and/or letters in the various examples. This repetition is for the purpose of simplicity and clarity and does not, in itself, dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to formation testing in open hole environments. Formation testing is routinely performed to evaluate subterranean formations that may contain hydrocarbon reservoirs. Transient pressure formation testing—which for brevity and without confusion will be simply referred to as formation testing—typically includes a draw-down phase, during which a pressure perturbation or transient is generated in the reservoir by formation fluid out of the reservoir (or withdrawing formation fluid from the reservoir), and a build-up phase, during which pumping (or fluid withdrawal) is stopped and the formation returns to a sand-face pressure equilibrium is monitored. Various reservoir parameters may be determined from the monitored pressure, such as formation pressure, formation fluid mobility in the reservoir and distances between the well being tested and flow barriers in the reservoir.

This disclosure describes apparatus and methods that may facilitate performing formation testing in an open hole environment. The apparatus and methods described herein may alleviate well control issues while performing formation testing. For example, an apparatus according to one or more aspects of the disclosure may comprise a formation testing assembly configured to permit a hydraulic bladder or packer of a blow-out-preventer or of a similar device to be closed around the formation testing assembly during formation testing, thereby sealing a well annulus. A method according to one or more aspects of the disclosure may involve circulating drilling mud into a bore of the formation testing assembly down to a downhole circulation sub or unit and back up through the well annulus during at least a portion of a formation test. A formation fluid recovered from the reservoir may be mixed downhole with the circulating drilling mud according to suitable proportions. The mixture of formation fluid and drilling mud may be circulated back to a surface separator via a choke line and/or a kill line towards a choke manifold.

FIG. 1 depicts an offshore well site according to one or more aspects of the present disclosure. The well site system may, however, be onshore (not shown). The well site system may be disposed above an open hole wellbore WB that may be drilled through subsurface formations, however, part of the wellbore WB may be cased using a casing CA.

The well site system may include a floating structure or rig S maintained above a wellhead W. A riser R may be fixedly connected to the wellhead W. A conventional slip or telescopic joint SJ, comprising an outer barrel OB affixed to the riser R and an inner barrel IB affixed to the floating structure S and having a pressure seal there between, may be used to compensate for the relative vertical movement or heave between the floating rig S and the riser R. A ball joint BJ may be connected between the top inner barrel IB of the slip joint SJ and the floating structure or rig S to compensate for other relative movement (horizontal and rotational) or pitch and roll of the floating structure S and the fixed riser R.

Usually, the pressure induced in the wellbore WB below the sea floor may only be that generated by the density of the drilling mud held in the riser R through hydrostatic pressure and gravity weight pressure. The overflow of drilling mud held in the riser R may be controlled using a rigid flow line RF provided about the level of the rig floor F and below a bell-nipple. The rigid flow line RF may communicate with a drilling mud receiving device such as a shale shaker SS and/or the mud pit MP. If the drilling mud is open to atmospheric pressure at the rig floor F, the shale shaker SS and/or the mud pit MP may be located below the level of the rig floor F.

During some operations (such as when performing formation testing in an open hole), gas may unintentionally enter the riser R from the wellbore WB. One or more of a diverter D, a gas handler and annular blow-out preventer GH, and a blow-out preventer stack BOPS may be provided. The diverter D, the gas handler and annular blow-out preventer GH, and/or the blow-out preventer stack BOPS may be used to limit gas accumulations in the marine riser R and/or to prevent formation gas from venting to the rig floor F. The diverter D, the gas handler and annular blow-out preventer GH, and/or the blow-out preventer stack BOPS, may not be activated when a pipe string such as pipe string PS is manipulated (rotated, lowered and/or raised) in the riser R. The diverter D, the gas handler and annular blow-out preventer GH, and/or the blow-out preventer stack BOPS may only be activated when indications of gas in the riser R are observed and/or suspected.

The diverter D may be connected between the top inner barrel IB of the slip joint SJ and the floating structure or rig S. When activated, the diverter D may be configured to seal around the pipe string PS using packers and to convey drilling mud and gas away from the rig floor F. For example, the diverter D may be connected to a flexible diverter line DL extending from the housing of the diverter D to communicate drilling mud from the riser R to a choke manifold CM. The drilling mud may then flow from the choke manifold CM to a mud-gas buster or separator MB and optionally to a flare line (not shown). The drilling mud may then be discharged to a shale shaker SS, and mud pits MP, or other drilling mud receiving device.

The gas handler and annular blow-out preventer GH may be installed in the riser R below the riser slip joint SJ. The gas handler and annular blow-out preventer GH may be configured to provide a flow path for mud and gas away from the rig floor F, and/or to hold limited pressure on the riser R upon activation. For example, a hydraulic bladder may be used to provide a seal around the pipe string PS. An auxiliary choke line ACL may be used to circulate drilling mud and/or gas from the riser R via the gas handler and annular blow-out preventer GH to a choke manifold CM on the floating structure or rig S.

The blow-out preventer stack BOPS may be provided between a casing string CS or the wellhead W and the riser R. The blow-out preventer stack BOPS may comprise one or more ram-type blow-out preventers. In addition, one or more annular blow-out preventers may be positioned in the blow-out preventer stack BOPS above the ram-type blow-out preventers. When activated, the blow-out preventer stack BOPS may provide a flow path for mud and/or gas away from the rig floor F, and/or to hold pressure on the wellbore WB. For example, the blow-out preventer stack BOPS may be in fluid communication with a choke line CL, a kill line KL, and a booster line BL connected between the desired ram blow-out preventers and/or annular blow-out preventers. The choke line CL may be configured to communicate with choke manifold CM. In addition to the choke line CL, the kill line KL and/or the booster line BL may be used to provide a flow path for mud and/or gas away from the rig floor F.

Figure 2:
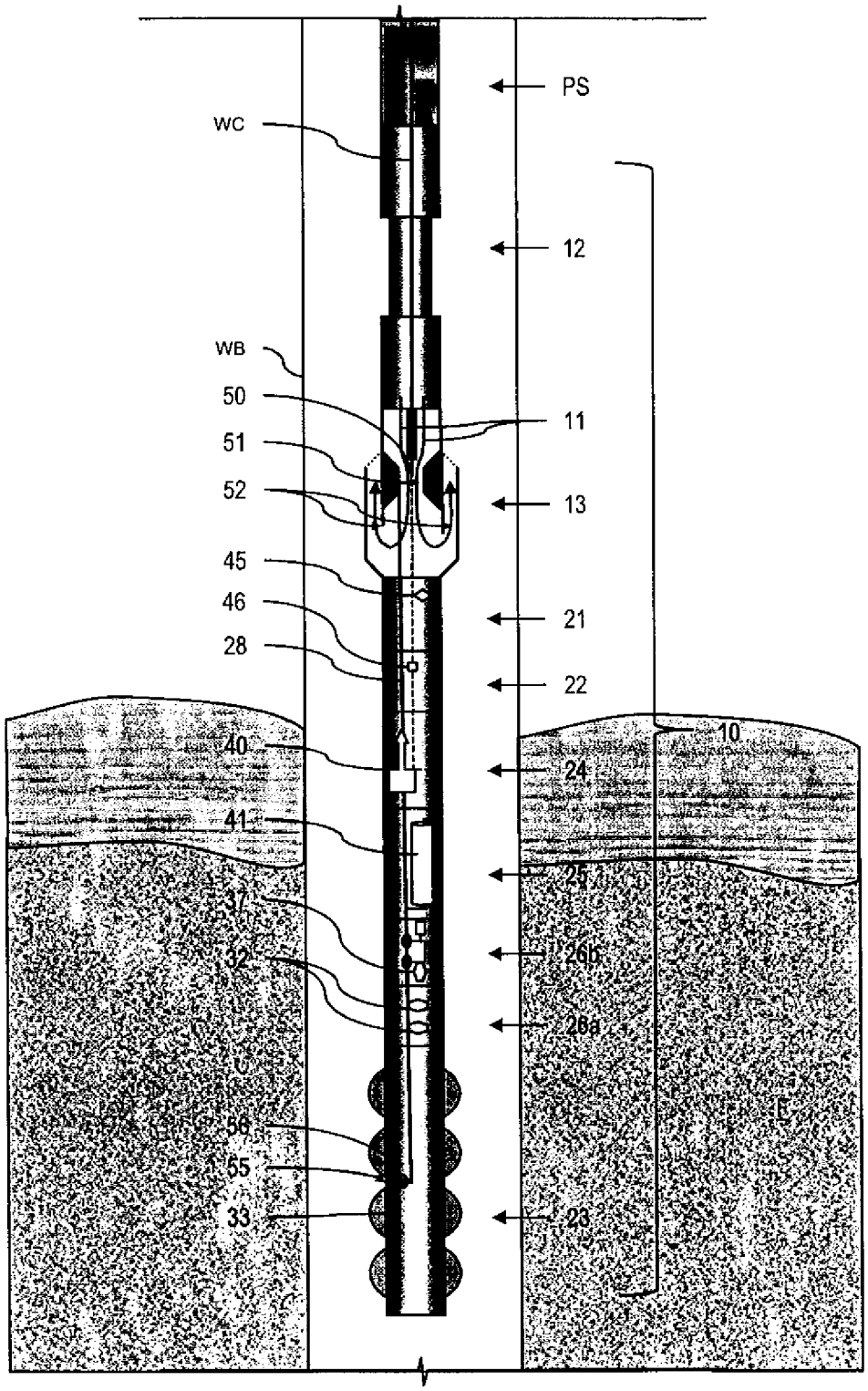
FIG. 2 is a schematic view of an apparatus according to one or more aspects of the present disclosure.

Referring collectively to FIGS. 1 and 2, the well site system may include a derrick assembly positioned on floating structure or rig S. A drill string including a pipe string portion PS and a tool string portion at a lower end thereof (e.g., the tool string 10 in FIG. 2) may be suspended in the wellbore WB from a hook HK of the derrick assembly. The hook HK may be attached to a traveling block (not shown), through a rotary swivel SW which permits rotation of the drill string relative to the hook HK. The drill string may be rotated by the rotary table RT. For example, the rotary table RT may engage a kelly at the upper end of the drill string. A top drive system could alternatively be used instead of the kelly, rotary table RT and rotary swivel SW.

The surface system may further include drilling mud stored in a mud tank or mud pit MP formed at the well site. A surface pump SP may deliver the drilling mud from the mud pit MP to an interior bore of the pipe string PS via a port PO in the swivel SW, causing the drilling mud to flow downwardly through the pipe string PS. The drilling mud may alternatively be delivered to an interior bore of the pipe string PS via a port in a top drive (not shown). The port PO may be configured to circulate mud to a downhole diverter sub 13. For example, the drilling mud may exit the pipe string PS via a fluid communicator 52 of the downhole diverter sub 13, as indicated by mud path 11. The fluid communicator 52 may be configured to allow fluid communication with an annulus between the tool string 10 and the wellbore wall. The downhole diverter sub 13 may also comprise a mixer configured to mix the drilling mud with a formation fluid pumped from a formation F, as further explained below. The drilling mud and/or the mixture of drilling mud and pumped formation fluid may then circulate upwardly through the annular region between the outside of the drill string and the wall of the wellbore WB, whereupon the drilling mud and/or the mixture of drilling mud and pumped formation fluid may be diverted to one or more of the choke line CL, the kill line KL, the booster line BL, the auxiliary choke line ACL, and/or the diverter line DL, among other return lines. A liquid portion of drilling mud and/or the mixture of drilling mud and pumped formation fluid may then be, at least partially, returned to the mud pit MP via the choke manifold CM and the mud-gas buster or separator MB. The liquid portion of drilling mud and/or the mixture of drilling mud and pumped formation fluid may also be at least partially pumped back into the wellbore WB, or otherwise disposed of. A gas portion of drilling mud and/or the mixture of drilling mud and pumped formation fluid may be vented, flared or otherwise disposed of.

The surface system may further include a logging unit LU. The logging unit LU may include capabilities for acquiring, processing, and storing information, as well as receiving commands from a surface operator via an interface. The logging unit LU may comprise a controller CO. The controller CO may be configured to maintain a proportion of at least one of a free and dissolved gas entrained with the pumped formation fluid below a threshold value in the circulating mud. For example, the controller CO may be communicatively coupled with tool string 10 and/or other sensors, such as a multiphase flow meter VX provided downstream of the mud-gas buster or separator MB. The controller CO may further be configured to control the pumping rate of the surface pump SP.

In the illustrated example, the logging unit LU (e.g., the controller CO) is communicatively coupled to an electrical wireline cable WC. The wireline cable WC may be configured to transmit data between the logging unit and one or more components of a downhole tool string (e.g., the tool string 10 in FIG. 2). While a wireline cable WC is shown in FIG. 1 to provide data communication, other arrangements and methodologies for providing data communication between the components of the tool string and the logging unit LU either ways (i.e., uplinks and/or downlinks) may be used, including a segmented conductive wire operatively coupled to the pipe string PS (sometimes referred to as "Wired Drill Pipe" or "WDP"), acoustic telemetry, fiber optics telemetry, and/or electromagnetic telemetry. The wireline cable WC may further be configured to send electrical power to one or more components of the downhole tool string (e.g., the tool string 10 in FIG. 2). Other methods and arrangements for providing electrical power to the components of the tool string may be used, including a mud driven turbine housed at the end of the pipe string PS and/or a segmented conductive wire operatively coupled to the pipe string PS.

Referring to FIG. 2, a tool string 10 configured for conveyance in the wellbore WB extending into a subterranean formation F is shown. The tool string 10 is suspended at the lower end of the pipe string PS. The tool string 10 may be of modular type. For example, the tool string 10 may include one or more of a slip joint 12 and a diverter sub 13 fluidly connected to the interior bore in the pipe string PS. The tool string 10 may also include a telemetry cartridge 21, a power cartridge 22, a formation testing device 23 having a plurality of packers, a pump module 24, a sample chamber module 25, and one or more fluid analyzer modules 26*a* and 26*b*. For example, these latter modules or cartridges may be implemented using downhole tools similar to those used in wireline operations. It should be appreciated that the arrangement of the modules or cartridges depicted in the tool string 10 may be changed and/or some of the modules or cartridges described may be combined, divided, rearranged, omitted, eliminated and/or implemented in other ways.

The slip joint 12 may be configured to permit relative translation between an upper portion of the tool string (i.e., the portion above the slip joint 12) attached to the pipe string PS, and a lower portion of the tool string (i.e., the portion below the slip joint 12), for example including one or more inflatable packers (e.g., disposed on the formation testing device 23) configured to selectively engage the wall of the wellbore WB. For example, the slip joint 12 may have an approximate adjustable length of 5 feet (1.52 meters) between collapsed and expanded positions. The slip joint 12 may be pressure compensated. Thus, the slip joint 12 would not induce compression and/or tension forces in the tool string 10 when drilling mud is circulated there through.

The diverter sub 13 may include a mixer 50, configured to mix the pumped formation fluid with circulating drilling mud. For example, the diverter sub 13 may be fluidly coupled to a main flow line 28 in which pumped formation fluid may flow. The main flow line 28 may terminate at a fluid communicator 51 (e.g., an exit port), configured to direct pumped formation fluid to a wellbore annulus between the tool string 10 and the wellbore wall. The diverter sub 13 may also be fluidly coupled to the interior bore of the pipe string PS. Drilling mud circulating in the interior bore of the pipe string PS may exit the pipe string PS via the fluid communicator 52. To facilitate the mixing or dilution of pumped formation fluid into the circulating drilling mud and/or for other advantages it may afford, the fluid communicator 51 may not be disposed deeper in the wellbore WB than the fluid communicator 52. The mixer 50 may also comprise a flow pattern modifier (e.g., a flow area restriction) disposed in the path 11 of the drilling mud towards in an interior bore of the diverter sub 13. The flow pattern modifier may include a pump, such as a jet pump. Upon circulation of the drilling mud, the flow area restriction may generate a high pressure zone (e.g., above the restriction as shown in FIG. 2) and a low pressure zone (e.g., at the restriction as shown in FIG. 2). In operation, drilling mud and formation fluid may be pumped in the jet pump. If the fluid communicator 51 is located in the low pressure zone of the jet pump, the output pressure of the main flow line 28 may be lower than the hydrostatic or hydrodynamic pressure of the drilling mud in the annulus between the tool string 10 and the wall of the wellbore WB. Thus, the amount of power used for pumping formation fluid through the main flow line 28 and into the wellbore WB may be reduced, or conversely, the rate at which formation fluid may be pumped through the main flow line 28 and into the wellbore WB using a given amount of power may be increased. Further, as the drilling mud velocity is higher in the low pressure zone, discharging pumped formation fluid into the low pressure zone may facilitate the mixing or dilution of pumped formation fluid into the circulated drilling mud. Still further, it should be appreciated that the low pressure zone of the jet pump may be maintained at a sufficient pressure so that gas contained in the formation fluid is not liberated as free gas in the drilling mud. Other flow pattern modifiers, such as protuberances configured to induce turbulence in the circulating drilling mud, static or dynamic mechanical mixers, may be used within the scope of the present disclosure.

The telemetry cartridge 21 and power cartridge 22 may be electrically coupled to the wireline cable WC, via a logging head (not shown) connected to the tool string 10 below the slip joint 12. The telemetry cartridge 21 may be configured to receive and/or send data communication to the wireline cable WC. The telemetry cartridge 21 may comprise a downhole controller 45 communicatively coupled to the wireline cable WC. For example, the downhole controller 45 may be configured to control the inflation/deflation of packers (e.g., packers disposed on formation testing device 23), the opening/closure of valves (e.g., the valve 56) to route fluid flowing in the main flow line 28, and/or the pumping of formation fluid, for example by adjusting the pumping rate of a downhole pump, such as the downhole pump 40. The downhole controller 45 may further be configured to analyze and/or process data obtained, for example, from various sensors disposed in the tool string 10 (for example, pressure/temperature gauge 33, fluid analysis sensors disposed in the fluid analyzer modules 26*a* and/or 26*b*, etc . . . ), store and/or communicate measurement or processed data to the surface for subsequent analysis. While the downhole controller 45 may be configured to receive data communication from the wireline cable WC extending within the wellbore WB, the downhole controller 45 may be configured to receive data communication from one or more of a segmented conductive wire operatively coupled to the pipe string, acoustic telemetry, fiber optics telemetry, and electromagnetic telemetry. The power cartridge 22 may comprise electronic boards 46, configured to receive electrical power from the wireline cable WC and to supply suitable voltage to the electronic components in the tool string 10, such as the downhole pump 40. While the downhole pump 40 may be configured to receive electrical power from the wireline cable WC extending within the wellbore WB, the downhole pump 40 may be configured to receive electrical power from at least one of a mud driven turbine housed in a downhole tool, and a segmented conductive wire operatively coupled to the pipe string PS.

The pump module 24 may comprise the downhole pump 40, configured to pump fluid from the formation F via a fluid communicator 55, and into the main flow line 28 through which the obtained fluid may flow and be selectively routed to sample chambers in sample chamber module (e.g., 25), fluid analyzer modules (e.g., 26*a* and/or 26*b*) and/or may be discharged to the wellbore WB as discussed above. The downhole pump 40 may comprise one or more of a hydraulically driven pump, an electrically driven pump, and a mechanically driven pump. Example implementations of the pump module 24 may be found in U.S. Pat. Nos. 4,860,581; 5,799,733; and 7,594,541 and/or U.S. Patent Application Pub. No. 2009/0044951, the disclosures of which are incorporated herein by reference.

The fluid analyzer module 26*a* may comprise one or more sensors 32, configured to monitor characteristics of the fluid extracted from the formation F and through the main flow line 28. For example, the fluid analyzer module 26*a* may include a density/viscosity sensor, for example as described in U.S. Patent Application Pub. No. 2008/0257036, the disclosure of which is incorporated herein by reference. The fluid analyzer module 26*a* may further include an optical fluid analyzer, for example as described in U.S. Pat. No. 7,379,180, the disclosure of which is incorporated herein by reference. The optical fluid analyzer may be configured to sense composition data; gas-to-oil ratio (GOR), gas content (e.g., methane content C1, ethane content C2, propane-butane-pentane content C3-05, carbon dioxide content $CO_2$), water content ($H_2O$), and/or stock tank oil content (C6+) may be monitored. It should be appreciated, however, that the fluid analyzer module may include any combination of conventional and/or future-developed sensors within the scope of the present disclosure.

The fluid analyzer module 26*b* may comprise a sensor 37 configured to sense a phase boundary (e.g., a bubble point pressure) of the fluid pumped from the formation F and sealed in a bypass flow line. An example implementation of the fluid analyzer module 26*b* may be found in U.S. Patent Application Pub. No. 2009/0078036, the disclosure of which is incorporated herein by reference. The fluid pumped from the formation F may be isolated in the bypass flow line and its pressure reduced or increased using a piston. The pressure at which an occurrence of another phase is detected (e.g., a gas phase), for example by a scattering detector, may be indicative of the phase boundary.

The formation testing device 23 may be disposed deeper in the wellbore WB relative to the downhole diverter sub 13. In operation, the formation testing device 23 may be used to isolate a portion of the annulus between the tool string 10 and the wall of the wellbore WB. The formation testing device 23 may also be used to extract fluid from the formation F traversed by the wellbore WB. Example implementations of the formation testing device 23 may be found in U.S. Patent Application Pub. No. 2008/0066535, the disclosure of which is incorporated herein by reference. For example, the formation testing device 23 may comprise the fluid communicator 55 positioned between first and second inflatable packers. The first and second packers may be configured to engage the wellbore WB proximate a formation F and seal an annular interval. The fluid communicator 55 may be configured to admit formation fluid from the annular interval and into the main flow line 28 of the tool string 10. The fluid communicator 55 may comprise a valve 56 proximate an inlet of the main flow line 28. The valve 56 may be configured to selectively prevent fluid communication between the downhole pump 40 and the annular interval. When performing formation testing, the valve 56 may be used to initiate a build-up phase. The build-up phase pressure may be monitored using the pressure and/or temperature gauge 33 in pressure communication with a portion the main flow line 28 between the inlet on the main flow line 28 and the valve 56, and configured to monitor the pressure/temperature of fluid pumped in the said portion of the main flow line 28 and/or of fluid inside the annular interval. The pressure and/or temperature gauge 33 may be implemented similarly to the gauges described in U.S. Pat. Nos. 4,547,691, and 5,394,345 (the disclosures of which are incorporated herein by reference), strain gauges, and combinations thereof. The formation testing device 23 may further comprise third and fourth inflatable packers each configured to engage the wellbore WB, wherein the first and second packers are positioned between the third and fourth packers. The third and fourth packers may be used to mechanically stabilize the annular interval sealed between the first and second packers. Thus, build-up pressure measured in the stabilized interval may be less affected by transient changes of wellbore pressure around the multiple packer system.

The sample chamber module 25 may comprise one or more stackable sample chambers 41 configured to retain a sample of formation fluid pumped from the formation F. For example, the sample chamber 41 may be of a type sometimes referred to as water cushion. It should be appreciated, however, that the sample chamber module 25 may include any combination of conventional and/or future-developed sample chambers within the scope of the present disclosure.

Figure 3:
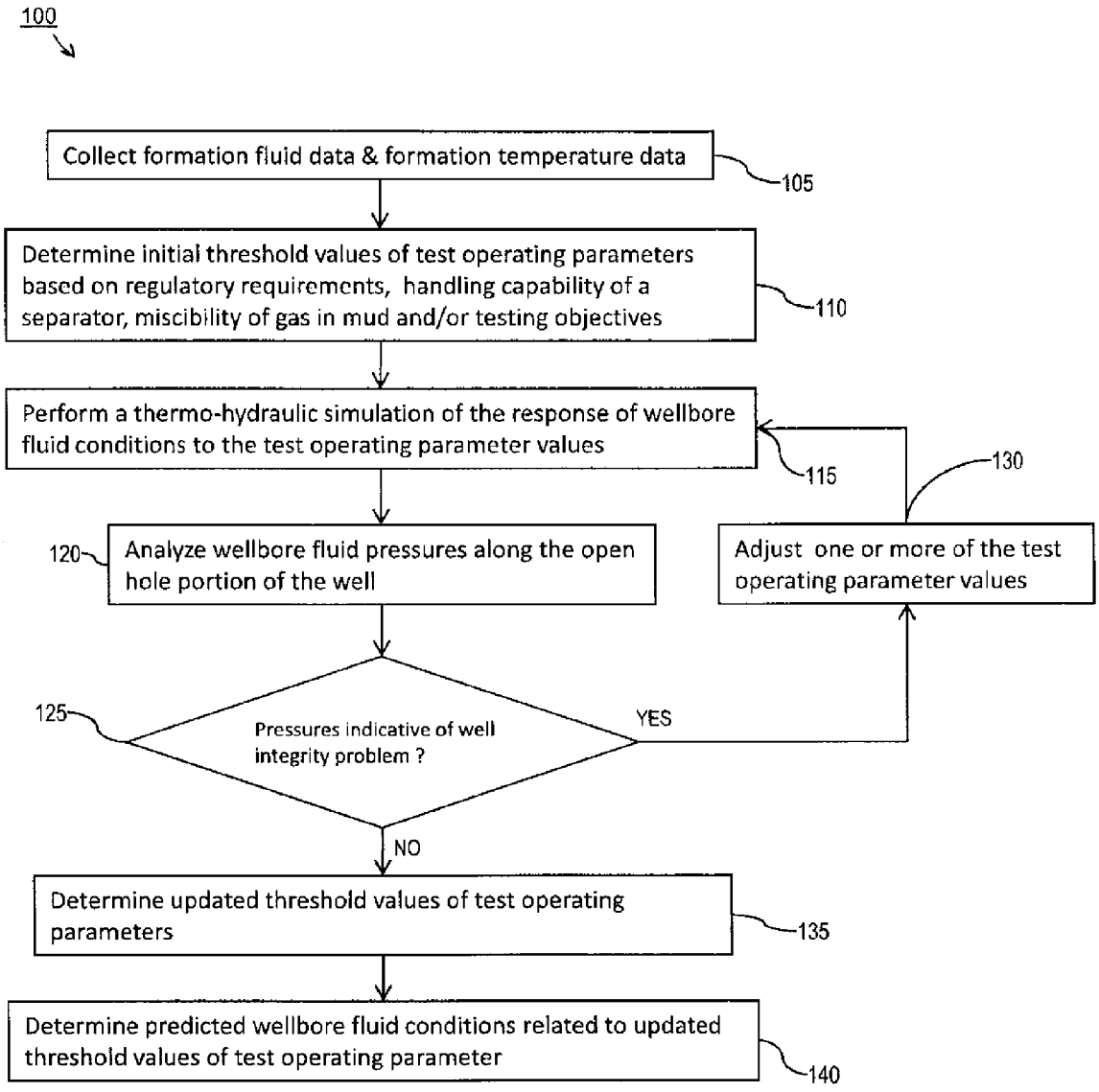
FIG. 3 is a flow-chart diagram of at least a portion of a method according to one or more aspects of the present disclosure.

FIG. 3 shows a flow chart of at least a portion of a method 100 of planning a formation test. The method 100 may be used to determine a threshold value of a proportion of gas pumped from the formation in the circulating mud. The proportion threshold value may be determined so that the pumped gas may be adequately mixed with circulating mud, and/or so that the well integrity is maintained. The method 100 may also be used to determine a threshold value of a flow rate of gas pumped from the formation F. The flow rate threshold value may be determined so that the gas released at the surface may be handled within the operational range of surface equipment and/or may be in compliance with regulatory requirements. It should be appreciated that the order of execution of the steps depicted in the flow chart of FIG. 3 may be changed and/or some of the steps described may be combined, divided, rearranged, omitted, eliminated and/or implemented in other ways.

At step 105, formation fluid data, and/or formation temperature data may be collected. For example, formation fluid data may include expected range of formation fluid composition, formation fluid gas-to-oil ratio or "GOR", formation gas and liquid densities, viscosities and/or compressibilities, formation gas and liquid solubilities in various drilling muds, bubble point pressure and temperature curves of mixtures of formation gas or liquid and various drilling muds, etc . . . The formation fluid data may have been collected during previous stages of the construction of the wellbore WB and/or from tests performed in other wells drilled in the same reservoir, through the analysis of fluid samples performed in surface laboratories, and/or from fluid thermodynamic models. Formation temperature data may include one or more temperature profiles acquired along a wellbore extending into subterranean formations in which formation testing is to be performed (e.g., the riser R in FIG. 1 and the wellbore WB in FIGS. 1 and 2), sea floor temperature, regional geothermal gradient information, etc . . . The formation temperature data may have been collected during previous stages in the construction of the wellbore WB.

At step 110, initial threshold values of test operating parameters, such as of formation fluid pumping flow rate, ratio of formation fluid pumping rate and drilling mud circulation rate, formation pumping duration or volume, may be determined, for example, based on regulatory requirements, gas handling capability of a separator, miscibility of gas in drilling mud and/or testing objectives. The initial threshold values of test operating parameters may be determined using the formation fluid data collected at step 105, such as expected range of gas content of the formation fluid and/or formation fluid gas-to-oil ratio. It will be appreciated that the formation gas may include free gas and/or dissolved gas at downhole conditions. However, the formation gas would usually be in a separate phase when reaching the Earth's surface.

The elution rate of the gas at the Earth's surface may be limited by regulatory requirements. If vented, the elution rate of the gas may be limited by the resulting concentration of regulated gas components near the rig, such as toxic components (hydrogen sulfide), flammable components (methane), etc. If flared, the elution rate of the gas may be limited by the resulting concentration of regulated combustion components, such as carbon monoxide, nitrogen oxide, etc., as well as by the regulated thermal power generated by flaring. The elution rate of the gas at the Earth's surface may also be limited by a gas handling capability of a surface separator (e.g., the mud-gas buster or separator MB in FIG. 1). For example, if a gravity separator is used, the elution rate of the gas at the Earth's surface may be limited by the capacity of the separator to separate mud mist from gas. Such limitations may be determined based on the API specification 12J "*Specification for Oil and Gas Separators*".

Assuming that the gas mass elution rate at the Earth's surface is approximately the mass flow rate of the gas pumped from the formation, the mass flow rate of the gas pumped from the formation F may thus be limited. Using the expected range of formation fluid gas content collected at step 105, the limitation on the mass flow rate of the gas pumped from the formation F may translate into a threshold value of the formation pumping rate. Thus, the threshold value of the formation pumping rate may be based on regulatory requirements and/or a gas handling capability of the surface separator. However, the formation pumping rate may also be determined by other factors, such as the operating limits of a downhole pump (e.g., the downhole pump 40 in FIG. 2), and/or the permeability or other characteristics of the formation being tested (e.g., the formation F in FIG. 2).

The proportion of gas in the circulating mud may be limited by the mud composition (for example the mud type) and the miscibility of gas in the circulating drilling mud. If the drilling mud comprises oil based mud, it may be advantageous to maintain the proportion of gas in the circulating drilling mud below a solubility threshold that may usually depend on pressure and temperature. Such solubility thresholds may be determined experimentally or theoretically. Examples of solubility thresholds may be found in SPE Paper Number 91009 entitled "*Gas Solubility in Synthetic Fluids: A Well Control Issue*" by C. T. Silva, J. R. L. Mariolani, E. J. Bonet, R. F. T. Lomba, O. L. A. Santos, and P. R. Ribeiro, in SPE Annual Technical Conference and Exhibition, 26-29 Sep. 2004, Houston, Tex., and/or in SPE Paper Number 116013 entitled "*Study of the PVT Properties of Gas—Synthetic Drilling Fluid Mixtures Applied to Well Control*" by E. N. Monteiro, P. R. Ribeiro, and R. F. T. Lomba, in SPE Annual Technical Conference and Exhibition, 21-24 Sep. 2008, Denver, Colo., USA. For example, the proportion of gas in the circulating mud may be maintained below the solubility threshold at the pressure in the wellbore WB at the testing location and the circulating mud temperature. The proportion of gas in the circulating mud may alternatively be maintained below the solubility threshold at the pressure in the wellbore WB at the shoe of the casing (e.g., the casing CA in FIG. 1) and the circulating mud temperature. If the drilling mud comprises water based mud, it may be advantageous to maintain the proportion of gas in the circulating drilling mud at such a level so as to insure that a bubble and/or dispersed bubble flow pattern is achieved. Bubble and/or dispersed bubble flow patterns may insure a more homogeneous transport of gas to the Earth's surface than other flow patterns, such as a slug flow pattern. Flow pattern maps (i.e., boundaries between flow patterns) may be determined experimentally or theoretically. Examples of flow pattern maps may be found in SPE Paper Number 79512 entitled "*An Experimental and Theoretical Investigation of Upward Two-Phase Flow in Annuli*" by Antonio C. V. M. Lage and Rune W. Time, in SPE Journal, Volume 7, Number 3, Pages 325-336, September 2002.

Using the proper unit conversions, the limitations on the proportion of gas in the circulating mud (e.g., water based mud or oil based mud) may translate into a threshold value of the ratio of formation fluid pumping rate and drilling mud circulation rate. Thus, the threshold value of the ratio of formation fluid pumping rate and drilling mud circulation rate may be based on the combinability of gas with drilling mud. However, the threshold value of the ratio of formation fluid pumping rate and drilling mud circulation rate may also be determined by other factors, such as the maximum flow rate in mud return lines (e.g., the choke line CL, the kill line KL, the booster line BL, the auxiliary choke line ACL, and/or the diverter line DL in FIG. 1).

The pumping duration or volume of formation fluid pumped may be determined based on measurement objectives of the formation test. For example, a minimum formation pumping duration or volume may be determined to achieve a suitable radius of investigation of the formation test to be performed. Example methods of determining a radius of investigation of formation tests may be found in SPE Paper Number 120515 entitled "*Radius of Investigation for Reserve Estimation From Pressure Transient Well Tests*" by Fikri J. Kuchuk, in SPE Middle East Oil and Gas Show and Conference, 15-18 Mar. 2009, Bahrain.

At step 115, a thermo-hydraulic simulation of the response of wellbore fluid conditions to the test operating parameter values (e.g., the initial threshold values determined at step 110) may be performed. For example, the response of wellbore fluid (comprising drilling mud and/or fluid pumped from the formation) may be computed or predicted with a thermo-hydraulic simulator using formation fluid data, and/or formation temperature data collected at step 105 such as formation gas and liquid densities, viscosities and/or compressibilities, bubble point pressure and temperature curves of mixtures of formation gas or liquid and various drilling muds, etc. The response of the wellbore fluid may include one or more of wellbore pressures and/or temperatures at selected locations along the well to be tested, dissolved and/or free gas fronts in the wellbore fluid, pit gains and gas elution rate from the well. For example, the temperature profile and the composition of the wellbore fluid (comprising drilling mud and/or fluid pumped from the formation) may be used to predict whether gas may be liberated at some point along the trajectory of the wellbore and the resulting consequences, such as, predicted wellbore pressure (e.g., potential unloading of the wellbore) and the expected mud pit gains. At least a portion of one example implementation of the thermo-hydraulic simulator may include the software package SideKick, provided by Schlumberger Technology Corporation. However, other existing or future developed software packages and/or models may alternatively be used or adapted to implement the thermo-hydraulic simulator.

At step 120, the wellbore fluid pressures along the open hole portion of the well computed or predicted at step 115 may be analyzed. For example, the wellbore fluid pressures along the open hole portion of the well may be compared to estimated formation pressure data, such as the formation pressure at the testing location. Also, the wellbore fluid pressures along the open hole portion of the well may be compared to estimated formation fracture strength data, such as the formation fracture strength at the casing shoe. Formation pressure data may include one or more pressure profiles measured across permeable formations traversed by a wellbore WB (for example, formation F in FIG. 2). Formation pressure data may also include data obtained from pressure sensors installed at locations along the wellbore WB, such as at the casing shoe, and/or the wellhead W and/or along the riser R in FIG. 1. The formation pressure data and/or the formation fracture strength data may have been collected during previous stages in the construction of the wellbore W and/or may be available from experience acquired from offset wells of the same construction.

At step 125, a determination whether the wellbore fluid pressures along the open hole portion of the well are indicative of a well integrity problem may be made. For example, formation pressure values that are found to be in excess of wellbore fluid pressures anywhere in the open hole portion of the well at step 120 may indicate that one or more formations penetrated by the well may start producing fluid into the well during the formation test, and thus may be indicative of a well integrity problem. Conversely, the well is maintained over balance, and thus no well integrity problem would be expected. Similarly, wellbore fluid pressures that are found to be in excess of formation fracture strength anywhere in the open hole portion of the well at step 120 may indicate a risk of fracture and leakage of wellbore fluid into the fractured formation, and thus may also be indicative of a well integrity problem. Conversely, the wellbore pressure is maintained below the fracture strength of the formation F, and thus no well integrity problem would be expected.

At step 130, one or more of the test operating parameter values and the testing tool configuration may be adjusted. The step 130 may be performed based on the determinations made at step 125. Thus, test operating parameter values may be iteratively adjusted based on the determinations made at step 125. For example, a drilling mud composition or type may be changed (e.g., its density may be increased or decreased). Further, drilling mud circulation rate may be increased, formation pumping flow rate may be decreased, and/or formation pumping duration or volume may be increased or decreased based on the radius of investigation of the formation tests.

At step 135, updated threshold values of the test operating parameters may be determined. For example, the updated threshold values may be obtained after iteration of steps 115, 120, 125, and 130 until the response of wellbore fluid conditions to the test operating parameter values is not indicative of well integrity problems. The updated threshold values may still be compatible with regulatory requirements, gas handling capability of a separator, combinability of gas with drilling mud and/or testing objectives.

At step 140, predicted wellbore fluid conditions related to updated threshold values of test operating parameters are determined. For example, one or more of predicted wellbore pressures and/or temperatures at selected locations, predicted pit gain, predicted gas elution rate from the well may be determined.

Figure 4A:
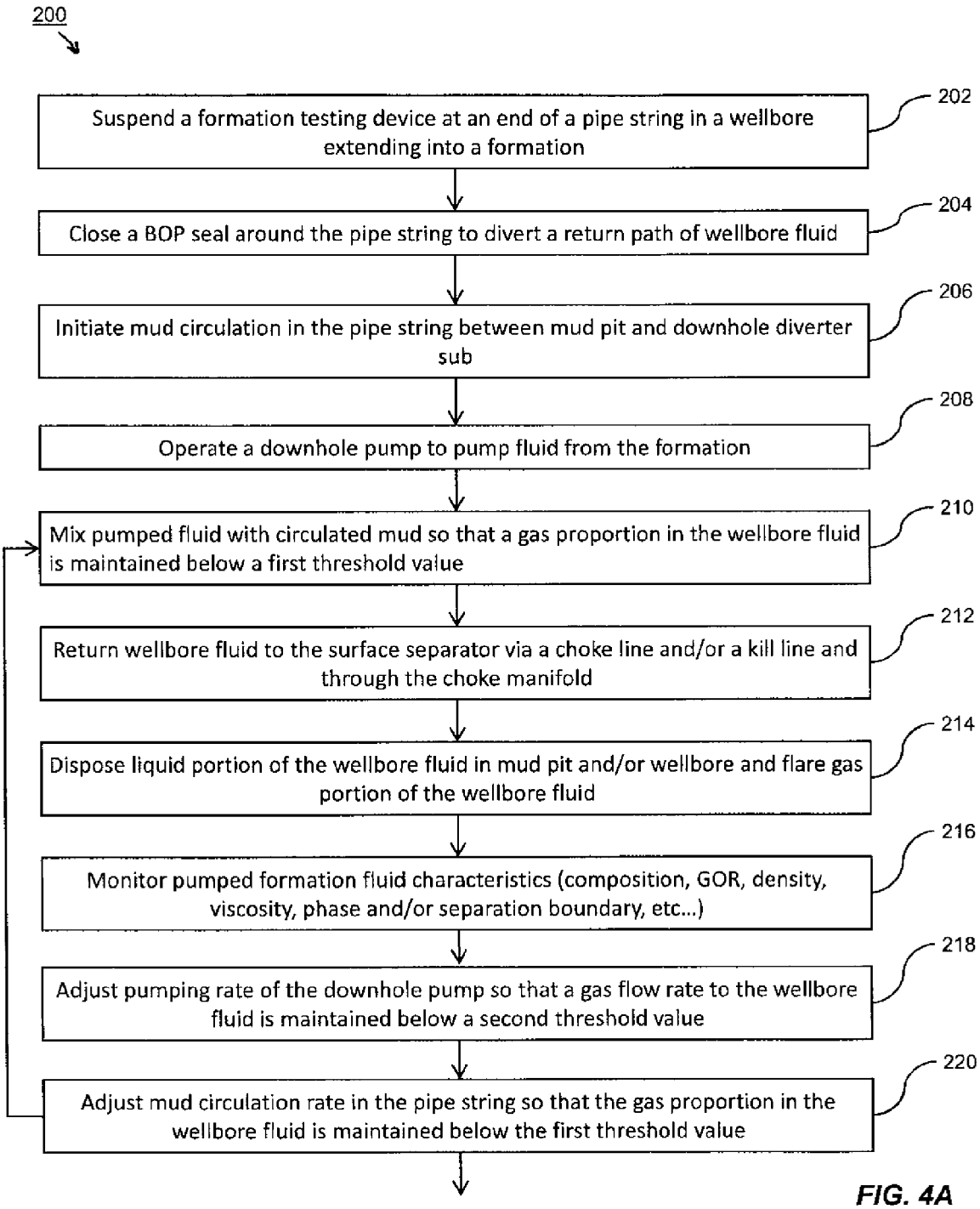
FIGS. 4A-4B are flow-chart diagrams of at least a portion of a method according to one or more aspects of the present disclosure.
Figure 4B:
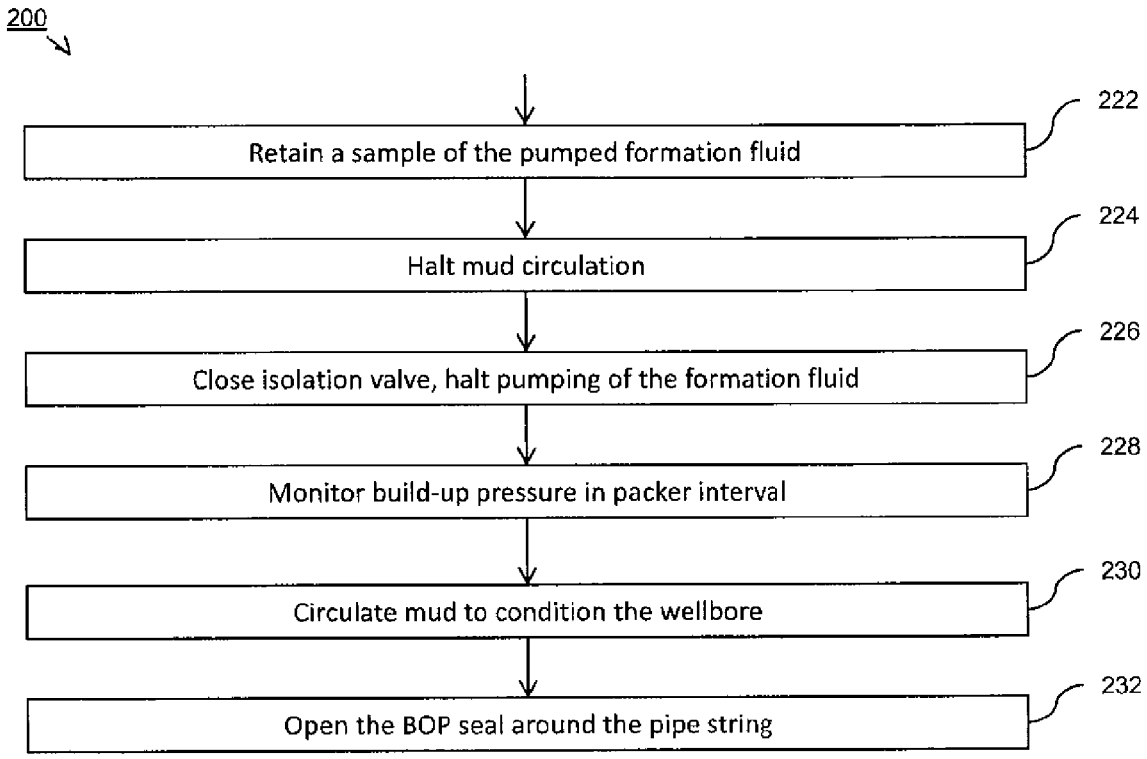

FIGS. 4A and 4B depict a flow chart of at least a portion of a method 200 of performing formation testing. The method 200 may be performed using, for example, the well site system of FIG. 1 and/or the tool string 10 of FIG. 2. The method 200 may alleviate well control issues while performing formation testing. It should be appreciated that the order of execution of the steps depicted in the flow chart of FIGS. 4A and 4B may be changed and/or some of the steps described may be combined, divided, rearranged, omitted, eliminated and/or implemented in other ways.

At step 202, modules of a tool string (e.g., the modules of the tool string 10 of FIG. 2) and segments of a pipe string (e.g., segments of the pipe string PS of FIGS. 1 and 2) may be assembled to form a drill string to be lowered at least partially into a wellbore (e.g., the wellbore WB in FIGS. 1 and 2). The tool string 10 and the pipe string segments may be assembled such that a formation testing device (e.g., the formation testing device 23 in FIG. 2) is suspended at the end of the pipe string and is essentially adjacent to a formation to be tested (e.g., the formation F in FIG. 2).

At step 204, a blow-out-preventer seal may be closed around the pipe string to divert a return path of the wellbore fluid away from the rig floor. For example, a hydraulic bladder, such as a hydraulic bladder provided with the blow-out preventer BOPS in FIG. 1, may be activated into sealing engagement against the pipe string to seal a well annulus. As mentioned before, other sealing devices may be used to seal a well annulus at step 204, such as seals provided with the diverter D, and/or the gas handler annular blow-out preventer GH in FIG. 1.

At step 206, circulation of drilling mud in the well may be initiated. For example, the drilling mud may be pumped from a mud pit (e.g., the mud pit MP in FIG. 1) down into a bore of the formation testing assembly using a surface pump (e.g., the surface pump SP in FIG. 1). The drilling mud may be introduced into the pipe string through a port in a rotary swivel (e.g., the port PO in FIG. 1) or through a port in a top drive (not shown). The drilling mud may then flow down in the pipe string to a first fluid communicator provided with a downhole diverter sub (e.g., the fluid communicator 52 of the diverter sub 13 of FIG. 2) and back up through the well annulus.

At step 208, the formation testing device (e.g., the formation testing device 23 in FIG. 2) may be set against the formation (e.g., the formation F in FIG. 2). A downhole pump (e.g., the downhole pump 40 in FIG. 2) may be operated to pump fluid from the formation (e.g., the formation F in FIG. 2) through a fluid communicator (e.g., the fluid communicator 55 in FIG. 2) and into a flow line of the formation testing device (e.g., the main flow line 28 in FIG. 2). The formation fluid may be pumped to a second fluid communicator (e.g., the fluid communicator 51 in FIG. 2).

At step 210, the fluid pumped from the formation may be mixed with circulating drilling fluid. For example, the formation fluid may be mixed with drilling mud at a mixer of the diverter sub (e.g., the mixer 50 in FIG. 2). The mixer may comprise, for example, a pump, such as a jet pump, through which drilling mud may circulate. The pumped formation fluid may be discharged adjacent the pump, such as at a low pressure side of the pump. Also, the first fluid communicator configured to allow drilling mud communication with an annulus of the wellbore may not be disposed deeper in the wellbore than the second fluid communicator configured to direct formation fluid to the annulus. In addition, a gas proportion in the wellbore fluid (comprising drilling mud and pumped fluid from the formation) may be maintained below a first threshold value. For example, the ratio of formation fluid pumping rate and drilling mud circulation rate may be set by a controller (e.g., the controller CO in FIG. 1) in accordance with the method 100 in FIG. 3. Thus, the gas proportion in the wellbore fluid may be controlled to allow for a well's integrity. The gas proportion in the wellbore fluid may also be controlled to allow for suitable miscibility between the pumped formation gas and the drilling mud (e.g., oil based mud and/or water based mud). Alternatively, the ratio of formation fluid pumping rate and drilling mud circulation rate may be set so that the gas proportion in the wellbore fluid is maintained below five percent in mass.

At step 212, the wellbore fluid may then be directed to one or more return lines (e.g., the choke line CL, the kill line KL, and/or the booster line BL in FIG. 1) towards a choke manifold (e.g., the choke manifold CM in FIG. 1), thereby reducing the risk of the drilling venting downhole gases on the rig floor (e.g., the rig floor F in FIG. 1). The wellbore fluid may be fed to a mud-gas buster or separator configured to separate a gas portion from a liquid portion of the wellbore fluid (e.g., the mud-gas buster MB in FIG. 1). Also, the wellbore fluid may be directed to a multiphase flow meter (e.g., the multiphase flow meter VX in FIG. 1). The multiphase flow meter may be configured to measure the flow properties of the wellbore fluid, for example as disclosed in U.S. Patent Application Pub. No. 2008/0319685, the disclosure of which is incorporated herein by reference. The measurements performed by the flow meter may be compared with predictions of gas elution rate obtained, for example, by performing the method 100 of FIG. 3. An operator may be alerted if the flow meter measurements deviates from the prediction, and remedial action may be initiated by the operator.

At step 214, a liquid portion of the wellbore fluid may be at least partially disposed in a mud pit (e.g., the mud pit MP in FIG. 1) and/or be at least partially left in a wellbore (e.g., the wellbore WB in FIG. 1). A gas portion of the wellbore fluid may be flared (for example natural gas may be flared), or vented (for example hydrogen sulfide may be vented). The liquid portion and the gas portion of the wellbore fluid may, however, be otherwise disposed of within the scope of the present disclosure. For example, the liquid portion may also be flared, or reinjected into a subterranean formation. The gas portion may be chemically treated (for example to produce elemental sulfur from hydrogen dioxide) and/or reinjected into a subterranean formation.

At step 216, a composition and/or a gas-to-oil ratio of the fluid pumped from the formation may be measured or monitored. For example, an optical fluid analyzer (e.g., the optical fluid analyzer 32 provided with the fluid analyzer module 26*a* in FIG. 1) may sense optical absorbances or optical densities at a plurality of wavelengths. A processor (e.g., provided with the controller CO in FIG. 1 and/or the controller 45 in FIG. 2) may be configured to process the sensed optical absorbances or optical densities at the plurality of wavelengths and determine pumped fluid parameters such as a gas-oil-ratio (GOR), a gas content (e.g., methane content C1, ethane content C2, propane-butane-pentane content C3-05, carbon dioxide content $CO_2$), and/or a water content ($H_2O$), among other parameters. For example, the processor may be configured to perform the processing methods disclosed in U.S. Pat. No. 7,586,087, the disclosure of which is incorporated herein by reference. The composition and/or the gas-to oil ratio of the fluid pumped from the formation measured at step 216 may be used to maintain a proportion of gas (such as free and/or dissolved gas) in the circulating drilling mud below the first threshold value, as further explained in the description of step 220. The composition and/or the gas-to oil ratio of the fluid pumped from the formation measured at step 216 may also be used to control a formation pumping rate so that the flow rate of gas (such as free and/or dissolved gas) is maintained below a second threshold value, as further explained in the description of step 218.

Additionally or alternatively, a phase boundary, a density and/or a viscosity of the fluid pumped from the formation may be measured or monitored at step 216. For example, the phase boundary (e.g., a bubble point pressure) of the fluid pumped from the formation may be sensed using the fluid analyzer module 26*b* as the fluid pumped from the formation is depressurized (or pressurized) in a bypass flow line. A density and/or viscosity sensor (e.g., the density and viscosity 32 provided with the fluid analyzer module 26*a* in FIG. 1) may sense the resonance frequency and quality factor of a vibrating object immersed in the fluid pumped from the formation to estimate the fluid's density and viscosity.

The formation fluid characteristics measured or monitored at step 216 (including one or more of composition, gas-to-oil ratio, phase boundary, density and/or the viscosity of the fluid pumped from the formation) may be compared with expected ranges of formation fluid data, such as the formation fluid data collected at step 105 of the method 100 in FIG. 3. A determination of whether the measured formation fluid characteristics deviate from expected ranges may be made. Based on the determination, the first and/or the second threshold values utilized at steps 210, 218 and/or 220 may be updated, for example by performing the method 100 using the formation fluid characteristics measured or monitored at step 216.

At step 218, the pumping rate of the downhole pump may be adjusted so that a gas flow rate into the wellbore fluid is maintained below a second threshold value. For example, the second threshold value may be determined by performing the method 100 in FIG. 3. Thus, the second threshold value may be based on a gas handling capability of a surface separator (e.g., the surface separator MB in FIG. 1) and/or regulatory requirements. An updated pumping flow rate may be determined based on a gas mass flow rate derived from the measurements performed at step 216 and the second threshold value. A command may be sent from a surface controller (e.g., the controller CO in FIG. 1) to a downhole controller (e.g., the controller 45) via a telemetry system (e.g., the wireline cable WC in FIGS. 1 and/or 2) and the downhole controller may adjust the pumping rate of the downhole pump to the updated flow rate.

At step 220, the drilling mud circulation rate may be altered. For example, the mud circulation rate in the pipe string may be adjusted so that the gas proportion in the wellbore fluid is maintained below the first threshold value. An updated mud circulating rate may be determined based on a gas mass flow rate derived from the measurements performed at step 216 and the first threshold value. A command may be sent from the surface controller (e.g., the controller CO in FIG. 1) to the surface pump (e.g., the surface pump SP in FIG. 1) to affect the pumping rate of the surface pump according to the updated mud circulating rate.

The operations described in relation to one or more of steps 210, 212, 214, 216, 218 and 220 may be repeated as formation fluid pumping continues. At step 222, a sample of fluid pumped from the formation may be retained in one or more sample chambers (e.g., the sample chamber 41 in FIG. 2).

At step 224, the mud circulation may be reduced or halted. Reducing the rate of or halting mud circulation may minimize pressure disturbances caused by mud circulation during the monitoring of a build-up phase of a formation test. For example, circulation of drilling fluid may induce flow of drilling mud filtrate through a mud-cake lining the wall of the wellbore penetrating the formation to be tested. The flow of drilling mud filtrate may in turn generate pressure disturbances measurable in the packer interval isolated at step 116. These pressure disturbances may negatively affect the interpretation of the pressure build-up measurement data collected at step 228. At step 226, a pressure build-up phase may be initiated by closing an isolation valve (e.g., the valve 56 provided with the fluid communicator 55 in FIG. 2). Then, the downhole pump used to pump fluid form the formation (e.g., the downhole pump 40 in FIG. 2) may be stopped. The isolation valve may be closed once sufficient fluid has been pumped from the formation to be tested, for example when the pumping volume or duration determined with the method 100 in FIG. 3 has been reached. At step 228, the build-up pressure may be monitored after mud circulation is halted. For example, the build-up pressure may be monitored using a pressure/temperature gauge configured to sense the fluid inside an annular interval sealed by two or more inflatable packers (e.g., the pressure gauge 33 provide with the formation testing device 23 in FIG. 2).

At step 230, the formation testing device (e.g., the formation testing device 23 in FIG. 2) may be retracted from the formation (e.g., the formation F in FIG. 2). The circulation of drilling mud may be restarted, for example when the monitoring of build-up pressure initiated at step 226 is deemed sufficient. The step 230 may be performed to condition the wellbore when fluid pumped from the formation and mixed with the drilling mud is still present in the well. By circulating this mixture through a mud-gas buster or separator (e.g., the mud-gas buster MB in FIG. 1), gas that may be present in the well may be essentially diverted away from the wellbore (e.g., the wellbore WB in FIG. 1), the riser (e.g., the riser R in FIG. 1) and/or away from the rig floor (e.g., the rig floor F in FIG. 1) before unsealing the well at step 232. At step 232, the blow-out-preventer seal closed around the pipe at step 204 may be opened. Thus, the formation testing device may be moved to another test location or retrieved from the wellbore.

In view of all of the above and FIGS. 1-4, this disclosure provides a method comprising initiating circulation of a mud in a pipe string from a mud pit through a surface port in the pipe string to a downhole diverter sub, wherein the pipe string is suspended in a wellbore extending into a subterranean formation, operating a downhole pump to pump formation fluid from the subterranean formation, wherein the formation fluid contains at least one of a free gas and a dissolved gas, and mixing the formation fluid that has been pumped with the mud that has been circulated to form a mixture of formation fluid and mud such that a proportion of the at least one of the free gas and the dissolved gas in the mud is maintained below a threshold value. The method may further comprise directing the mixture of pumped formation fluid and circulating mud to a multiphase flow meter. The method may further comprise directing the mixture of pumped formation fluid and circulating mud to the mud pit through a choke manifold via at least one of a choke line and a kill line. The method may further comprise directing the mixture of pumped formation fluid and circulating mud to a surface separator configured to separate a gas portion from a liquid portion of the mixture. The method may further comprise disposing the liquid portion of the mixture at least partially in the mud pit. The method may further comprise disposing the liquid portion of the mixture at least partially in the wellbore. The method may further comprise flaring the gas portion of the mixture. The threshold value may be a first threshold value, and the method may further comprise controlling a formation fluid pumping rate so that a flow rate of the at least one of free and dissolved gas is maintained below a second threshold value. The second threshold value may be determined based on a gas handling capability of the surface separator. The second threshold value may be determined based on a regulatory requirement. The threshold value may be lower than approximately five percent in mass. The threshold value may be determined to insure well integrity. The mud may comprise oil based mud, and the threshold value may be determined based on a solubility of gas in oil based mud. The mud may comprise water based mud, and the threshold value may be determined based on a flow regime of gas in water based mud. The threshold value may be determined to maintain a bubble flow regime of gas in water based mud. The method may further comprise closing a blow-out-preventer seal around the pipe string. The method may further comprise opening the blow-out-preventer seal. The method may further comprise reducing mud circulation. The method may further comprise monitoring build-up pressure data after reducing mud circulation. Reducing mud circulation may comprise halting mud circulation. The method may further comprise circulating mud after monitoring build-up pressure data. Circulating mud after halting pumping of the formation fluid may comprise conditioning the wellbore. The method may further comprise altering a mud circulation rate. Circulating mud in the pipe string may comprise circulating mud to a first fluid communicator configured to allow fluid communication with an annulus of the wellbore, mixing the pumped formation fluid with circulating mud may comprise pumping formation fluid from the formation to a second fluid communicator configured to direct formation fluid to the annulus, and the second fluid communicator may not be disposed deeper in the wellbore than the first fluid communicator. Mixing the pumped formation fluid with circulating mud may comprise circulating mud through a pump and discharging pumped formation fluid adjacent the pump. The pump may comprise a jet pump. Discharging pumped formation fluid adjacent the pump may comprise discharging pumped formation fluid at a low pressure side of the pump. The method may further comprise measuring a composition of the formation fluid pumped from the formation. The method may further comprise measuring a gas-to-oil ratio of the formation fluid pumped from the formation. The method may further comprise measuring a phase boundary of the formation fluid pumped from the formation. The method may further comprise measuring a density and a viscosity of the formation fluid pumped from the formation. The method may further comprise retaining a sample of the formation fluid pumped from the formation. The method may further comprise halting operating the downhole pump and monitoring build-up pressure data.

The present disclosure also provides an apparatus comprising a downhole diverter sub, a pipe string configured to be suspended in a wellbore extending into a subterranean formation, wherein the pipe string comprises a surface port configured to circulate mud to a downhole diverter sub, a downhole pump configured to pump formation fluid from the formation, a mixer configured to mix the pumped formation fluid with circulating mud, and a controller configured to maintain a proportion of at least one of a free and dissolved gas of the formation fluid that has been pumped in the mud below a threshold value. The mixer may comprise a first fluid communicator configured to allow fluid communication with an annulus of the wellbore, a second fluid communicator configured to direct pumped formation fluid to the annulus, and the second fluid communicator may not be disposed deeper in the wellbore than the first fluid communicator. The apparatus may further comprise a formation testing device disposed deeper in the wellbore relative to the downhole diverter sub. The formation testing device may comprise first and second inflatable packers each configured to engage the wellbore proximate the formation, and a third fluid communicator positioned between the first and second packers. The formation testing device may further comprise third and fourth inflatable packers each configured to engage the wellbore, wherein the first and second packers are positioned between the third and fourth packers. The third fluid communicator may further be configured to selectively prevent fluid communication between the downhole pump and the annulus. The apparatus may further comprise a pressure compensated slip joint having an adjustable length. The apparatus may further comprise a sensor configured to sense composition data of the formation fluid pumped from the formation. The apparatus may further comprise a sensor configured to sense a gas-to-oil ratio of the formation fluid pumped from the formation. The apparatus may further comprise a sensor configured to sense a phase boundary of the formation fluid pumped from the formation. The apparatus may further comprise a sensor configured to sense a density and a viscosity of the formation fluid pumped from the formation. The downhole pump may comprise at least one of a hydraulically driven pump, an electrically driven pump, and a mechanically driven pump. The apparatus may further comprise at least one sample chamber configured to retain a sample of the formation fluid pumped from the formation. The downhole pump may be configured to receive electrical power from at least one of a mud driven turbine housed in a downhole tool, a segmented conductive wire operatively coupled to the pipe string and an electrical cable extending within the wellbore. The apparatus may further comprise a downhole controller configured to control a pumping rate of the downhole pump. The controller may be configured to receive data communication from at least one of an electrical cable extending within the wellbore, a segmented conductive wire operatively coupled to the pipe string, acoustic telemetry, fiber optics telemetry, and electromagnetic telemetry. The mixer may comprise a pump. The pump may comprise a jet pump. The pump may be configured to reduce an output pressure of the downhole pump.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method, comprising:

initiating circulation of a mud in a pipe string from a mud pit through a surface port in the pipe string to a downhole diverter sub, wherein the pipe string is suspended in a wellbore extending into a subterranean formation;

operating a downhole pump to pump formation fluid from the subterranean formation, wherein the formation fluid contains at least one of a free gas or a dissolved gas;

mixing the formation fluid that has been pumped with the mud that has been circulated to form a mixture of formation fluid and mud such that a proportion of the at least one of the free gas or the dissolved gas in the mixture is maintained below a threshold value determined at least in part based on a gas content of the formation fluid;

performing a thermo-hydraulic simulation to predict a response of the mixture to conditions of the subterranean formation, wherein the response comprises fluid pressures of the mixture; and adjusting the threshold value in response to determining that the fluid pressures of the mixture indicate a wellbore integrity condition.

2. The method of claim 1, further comprising:

directing the mixture of formation fluid and mud to a multiphase flow meter.

3. The method of claim 1, further comprising:

directing the mixture of formation fluid and mud through a choke manifold via at least one of a choke line and a kill line.

4. The method of claim 1, further comprising:

directing the mixture of formation fluid and mud to a surface separator configured to separate a gas portion from a liquid portion of the mixture.

5. The method of claim 1, further comprising:

measuring at least one of a phase boundary, a density and a viscosity of the formation fluid pumped from the formation.

6. The method of claim 1, further comprising:

reducing mud circulation.

7. The method of claim 6, further comprising:

monitoring build-up pressure data after reducing mud circulation.

8. The method of claim 1, comprising determining a ratio, of a pumping rate of the formation fluid to a circulation rate of the mud, as the threshold value.

9. An apparatus, comprising:

a downhole diverter sub;

a pipe string configured to be suspended in a wellbore extending into a subterranean formation, wherein the pipe string comprises a surface port configured to circulate a mud to the downhole diverter sub;

a downhole pump configured to pump formation fluid from the formation, wherein the formation fluid comprises at least one of a free gas or a dissolved gas;

a mixer configured to mix the formation fluid that has been pumped with the mud that is circulating to form a mixture of the formation fluid and the mud; and a controller configured to:

maintain a proportion of at least one of the free gas or the dissolved gas in the mixture below a threshold value determined at least in part based on a gas content of the formation fluid;

perform a thermo-hydraulic simulation to predict a response of the mixture to conditions of the subterranean formation, wherein the response comprises fluid pressures of the mixture; and adjust the threshold value in response to determining that the fluid pressures of the mixture indicate a wellbore integrity condition.

10. The apparatus of claim 9, wherein the mixer comprises:

a first fluid communicator configured to allow fluid communication with an annulus of the wellbore; and a second fluid communicator configured to direct the formation fluid that has been pumped to the annulus, wherein the second fluid communicator is not disposed deeper in the wellbore than the first fluid communicator.

11. The apparatus of claim 9, comprising a formation testing device disposed deeper in the wellbore relative to the downhole diverter sub, wherein the formation testing device comprises:

first and second inflatable packers each configured to engage the wellbore proximate the subterranean formation; and a third fluid communicator positioned between the first and second packers.

12. The apparatus of claim 11, wherein the formation testing device further comprises third and fourth inflatable packers each configured to engage the wellbore, wherein the first and second packers are positioned between the third and fourth packers.

13. The apparatus of claim 9, further comprising:

a sensor configured to sense composition data of the formation fluid pumped from the formation.

14. The apparatus of claim 9, further comprising:

a sensor configured to sense a gas-to-oil ratio of the formation fluid pumped from the formation.

15. The apparatus of claim 9, further comprising:

at least one sample chamber configured to retain a sample of the formation fluid pumped from the formation.

16. The apparatus of claim 9, wherein the downhole pump is configured to receive electrical power from at least one of a mud driven turbine housed in a downhole tool, a segmented conductive wire operatively coupled to the pipe string and an electrical cable extending within the wellbore.

17. The apparatus of claim 9, wherein the controller is configured to determine a ratio, of a pumping rate of the formation fluid to a circulation rate of the mud, as the threshold value.

18. A method, comprising:

initiating circulation of a mud in a pipe string from a mud pit through a surface port in the pipe string to a downhole diverter sub, wherein the pipe string is suspended in a wellbore extending into a subterranean formation;

operating a downhole pump to pump formation fluid from the subterranean formation, wherein the formation fluid contains at least one of a free gas or a dissolved gas;

determining a ratio, of a pumping rate of the formation fluid to a circulation rate of the mud, as a threshold value; and mixing the formation fluid that has been pumped with the mud that has been circulated to form a mixture of formation fluid and mud such that a proportion of the at least one of the free gas or the dissolved gas in the mixture is maintained below the threshold value, wherein the ratio representing the threshold value is determined at least in part based on a gas content of the formation fluid.

19. An apparatus, comprising:

a downhole diverter sub;

a pipe string configured to be suspended in a wellbore extending into a subterranean formation, wherein the pipe string comprises a surface port configured to circulate a mud to the downhole diverter sub;

a downhole pump configured to pump formation fluid from the formation, wherein the formation fluid comprises at least one of a free gas or a dissolved gas;

a mixer configured to mix the formation fluid that has been pumped with the mud that is circulating to form a mixture of the formation fluid and the mud; and a controller configured to:

determine a ratio, of a pumping rate of the formation fluid to a circulation rate of the mud, as a threshold value; and maintain a proportion of at least one of the free gas or the dissolved gas in the mixture below the threshold value, wherein the ratio representing the threshold value is determined at least in part based on a gas content of the formation fluid.

* * * * *